US005687835A

United States Patent [19]

Schuler et al.

[11] Patent Number: 5,687,835

[45] Date of Patent: Nov. 18, 1997

[54] DRIVE FOR AN ELECTRIC HIGH VOLTAGE CIRCUIT-BREAKER

[75] Inventors: Klaus Schuler, Berlin; Hans Niemeier, Noerdlingen, both of Germany

[73] Assignee: Siemens Aktiengesellschaft, München, Germany

[21] Appl. No.: 596,173

[22] PCT Filed: Aug. 9, 1994

[86] PCT No.: PCT/DE94/00944

§ 371 Date: Apr. 12, 1996

§ 102(e) Date: Apr. 12, 1996

[87] PCT Pub. No.: WO95/05672

PCT Pub. Date: Feb. 23, 1995

[30] Foreign Application Priority Data

Aug. 13, 1993 [DE] Germany ..... 43 27 676.8

[51] Int. Cl.[6] ..... H01H 5/00

[52] U.S. Cl. ..... 200/400; 74/2; 464/44

[58] Field of Search ..... 200/400; 74/2, 74/97.1; 188/83; 464/42, 43, 44

[56] References Cited

U.S. PATENT DOCUMENTS

| | | | |
|---|---|---|---|
| 2,569,144 | 9/1951 | Benson | 464/44 |
| 4,240,300 | 12/1980 | Tanaka . | |
| 4,491,709 | 1/1985 | Chabot et al. . | |
| 4,762,971 | 8/1988 | Yabe . | |
| 4,805,706 | 2/1989 | Stone | 464/44 |

FOREIGN PATENT DOCUMENTS

| | | | |
|---|---|---|---|
| 497753 | 9/1919 | France | 464/43 |
| 25 18 599 | 9/1976 | Germany . | |
| 36 23 247 | 6/1989 | Germany . | |

*Primary Examiner*—David J. Walczak

*Attorney, Agent, or Firm*—Kenyon & Kenyon

[57] ABSTRACT

A drive for an electric high voltage circuit-breaker has a revolving crank that is driven by an energy storage mechanism, such as a spring, between an upper dead center and a bottom dead center and a backstop that prevents the crank from moving backwards against the driving direction after it moves beyond the bottom dead center. The backstop is provided with a friction clutch with a first ring that is firmly coupled to the crank and the driving shaft and that can rotate in relation to a second return stop ring when a releasing force is exceeded.

5 Claims, 2 Drawing Sheets

DRIVE FOR AN ELECTRIC HIGH VOLTAGE CIRCUIT-BREAKER

FIELD OF THE INVENTION

The present invention relates to a drive for an electric high voltage circuit breaker, in particular to a drive with a revolving crank and a backstop mechanism.

BACKGROUND OF THE INVENTION

German Patent No. 36 23 247 describes a drive for an electric high voltage circuit-breaker with a revolving crank driven by means of a drive spring. The drive described in German Patent No. 36 23 247 includes a backstop that is used principally to permit stepwise tensioning of the drive spring by rotation of the driving shaft, backward rotation of the driving shaft after each tensioning step being prevented by the backstop.

A backstop of this kind can also be used after a switching operation, i.e. when the energy storage mechanism is discharged and the crank is moving beyond its bottom dead center, to prevent the crank from moving backwards so that it comes to rest more quickly and the energy storage mechanism can accordingly be quickly recharged and so that the crank does not damage or endanger other parts of the switch when pivoting back.

Given the large drive forces necessary during operation of a high voltage circuit-breaker, this backstop must also be configured to ensure that it operates as desired over the long term.

SUMMARY OF THE INVENTION

The present invention is directed to a drive for an electric high voltage circuit-breaker with a revolving crank that may be driven by means of an energy storage mechanism between an upper dead center and a bottom dead center, and a backstop that prevents the crank from moving backwards against the driving direction after it moves beyond the bottom dead center.

An object of the present invention is to provide a high voltage circuit breaker drive that can operate reliably with a long operating life by alleviating the mechanical loads on the backstop.

The object is achieved, according to the present invention, by the fact that the backstop has a friction clutch with a first ring that is firmly coupled to the crank, and with a second return stop ring, that are rotatable in relation to one another when a releasing force is overcome.

As a result of the friction clutch according to the present invention, the backstop does not take effect abruptly, but rather in damped form. When large forces occur, the friction clutch will initially slip, and after the switching operation the crank will pivot back some distance opposite to the driving direction, before the backstop engages and the crank is immobilized. Slippage of the friction clutch dissipates a portion of the excess energy, for example by friction.

An advantageous embodiment of the present invention provides for elastic means, to press the first ring against the second ring creating a frictional engagement, to be provided. Mechanical coupling of the first ring to the second ring is thus guaranteed by means of a frictional engagement, the releasing force of the friction clutch being adjustable by means of the force with which the first ring and second ring are pressed against each other.

A further advantageous embodiment of the present invention provides for the rings to be arranged lying concentrically inside one another; for the mutually facing peripheral surfaces of the rings to be configured conically and in complementary fashion to one another; and for elastic means to compress the rings in the axial direction to be provided.

The result is a particularly simple physical configuration in which, depending on the configuration of the cone, high frictional forces can be achieved between the first ring and the second ring by means of relatively low pressing forces. In addition, a single helical spring is sufficient to exert the pressure, and a relatively small size for the friction clutch is achieved.

A further advantageous embodiment of the present invention provides for the rings to have recesses at their mutually facing delimiting surfaces; and for elastic elements, which each engage into at least one recess of each of the rings and are elastically deformable when the rings rotate with respect to one another, to be provided.

In this case the excess energy prior to firm coupling of the friction clutch is converted into a deformation of the elastic elements. In addition, a frictional engagement can be provided between the first and second ring.

Advantageously, the rings can be arranged lying concentrically inside one another, and the elastic elements can be formed by leaf springs.

The leaf springs can, for example, be mounted in the inner ring and project into recesses of the outer ring. It is also possible for the leaf springs to be rolled up into rings, one each of which is arranged in a recess overlapping the first and the second ring.

DETAILED DESCRIPTION

Figure 1:
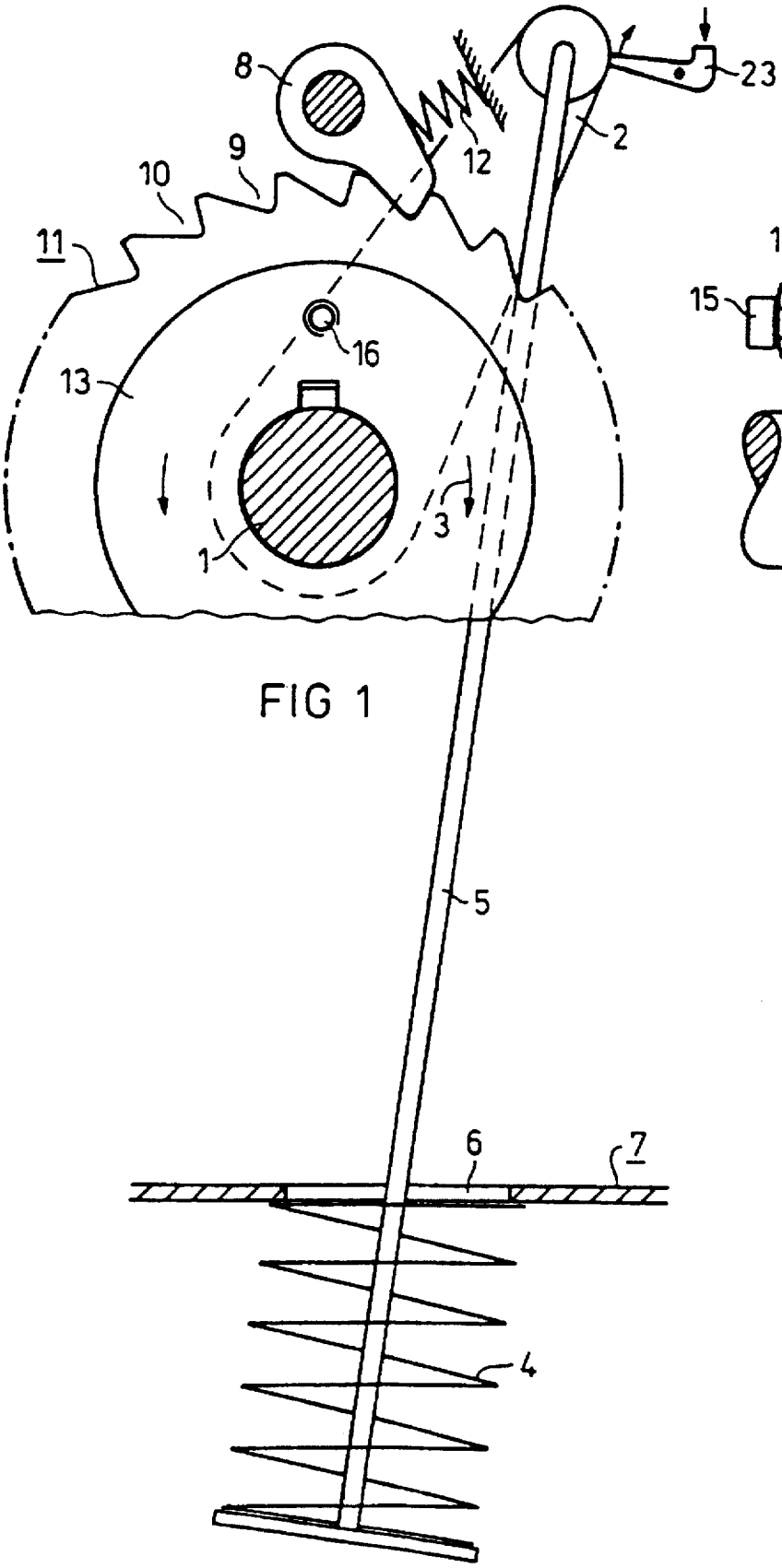
FIG. 1 shows a friction clutch with frictional engagement for a first embodiment of a circuit-breaker drive in accordance with the present invention.
Figure 2:
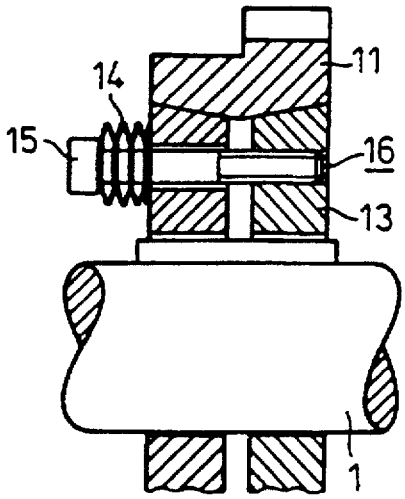
FIG. 2 shows a partial cross-sectional view of the friction clutch of FIG. 1.

FIG. 1 shows a drive for a high voltage circuit-breaker with a driving shaft 1 on which is mounted, for example, a cam plate (not depicted), by means of which a breaker unit (also not depicted) of the circuit-breaker can be actuated during the switching operation. Mounted on driving shaft 1 is crank 2, which is depicted in FIG. 1 in its locked position before the switching operation. For simplicity's sake, the locking device itself is depicted only schematically by lever 23.

During switching, crank 2 is released by locking device 23 so that driving shaft 1 rotates clockwise and crank 2 pivots in the direction of arrow 3. Helical spring 4, constituting the energy storage mechanism, extends and thereby pulls connecting rod 5 downward through an opening 6 in a stationary plate 7.

When crank 2 has moved beyond its bottom dead center, i.e. when helical spring 4 has reached its greatest extension, both driving shaft 1 and crank 2 continue moving clockwise, since the moving parts of the switch still possess dynamic energy after passing through the bottom dead center.

As a result, helical spring 4 is compressed slightly further until crank 2 is braked.

At this point, crank 2 is to be prevented from swinging back. A ratchet 8, 20, which engages into recesses 9, 10 of a second ring 11, is provided for this purpose. Ratchet 8 is mounted in stationary fashion, and is pressed by means of spring 12 into the recesses of second ring 11. This prevents any counter-clockwise rotation of second ring 11; the second ring is immobilized.

Arranged inside second ring 11 is a first ring 13, consisting of two partial rings, that is permanently joined to driving shaft 1. The two partial rings of first ring 13 are configured conically in opposite directions from one another at their outer peripheral surfaces, and are pressed together by means of springs 14. Each of the partial rings of first ring 13 is thus pressed against a conical partial surface of the inner peripheral surface of second ring 11, thus creating a frictional engagement between first ring 13 and second ring 11. Springs 14 are braced against screw heads 15 of screws 16 that pass through one of the partial rings of first ring 13 with clearance, and are threaded into the other partial ring by means of threads. The force with which the partial rings of first ring 13 are pressed against the inner peripheral surface of second ring 11 can be adjusted by means of the strength or preload of springs 14. The frictional force between first ring 13 and second ring 11, and thus the releasing force for the friction clutch, can thereby be adjusted.

When crank 2 swings back counterclockwise, first ring 13 moves along slightly farther together with crank 2 and driving shaft 1, while second ring 11 is held back by ratchet 8. As soon as the return force exerted on crank 2 by helical spring 4 has become so small that the frictional forces between first ring 13 and second ring 11 are greater, further rotation of first ring 13 and thus of driving shaft 1 and crank 2 is prevented. The driving shaft is then immobilized in this position.

Figure 3:
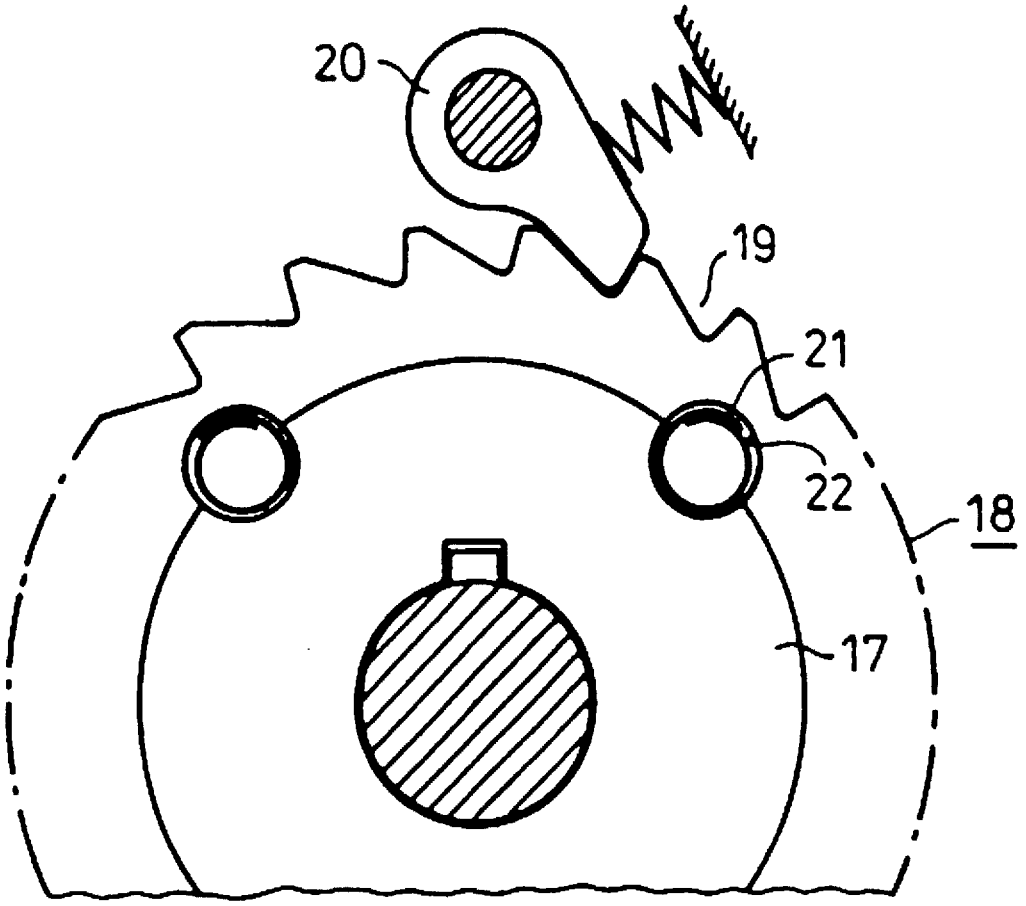
FIG. 3 shows a friction clutch with elastic elements for a second embodiment of a circuit-breaker drive in accordance with the present invention.

FIG. 3 shows a friction clutch that consists of a first, inner ring 17 and a second, outer ring 18, surrounding the latter, that has on its outer peripheral surface recesses 19 into which a stationary ratchet 20 engages, as applicable, to immobilize outer ring 18. Coupling of outer ring 18 with inner ring 17 is produced by leaf spring elements 21 which each consist of a helically coiled leaf spring element and are arranged in a cylindrical recess 22 engaging into both outer ring 18 and inner ring 17. When inner ring 17 is rotated with respect to outer ring 18, the parts of recesses 22 arranged in the two rings 17, 18 are displaced with respect to one another, such that leaf springs 21 are elastically deformed and exert a counterforce against rotation of the rings. The deformation limit of leaf springs 21 is reached after first ring 17 has completed a certain rotation travel with respect to second ring 18, so that a positive engagement is achieved between rings 17, 18. Driving shaft 1 is thus stopped at that time.

What is claimed is:

1. A drive for an electric high voltage circuit-breaker, comprising:

a revolving crank that can be driven in a driving direction by an energy storage mechanism between an upper dead center and a bottom dead center position; and a backstop for preventing the crank from moving backwards for more than a predetermined distance against the driving direction after the crank moves beyond the bottom dead center position, wherein the backstop includes a friction clutch having a first ring that is firmly coupled to the crank, and a second return stop ring that is rotatable relative to the first ring when a releasing force is overcome, and wherein the crank moves against the driving direction until a frictional engagement between the first ring and the second return stop ring prevents the crank from moving against the driving direction for more than the predetermined distance.

2. The drive according to claim 1, wherein the friction clutch includes an elastic means for pressing the first ring against the second ring, thereby creating the frictional engagement between the first and second rings.

3. The drive according to claim 2, wherein:

the first and second rings are arranged lying concentrically inside one another;

mutually facing peripheral surfaces of the first and second rings are configured conically and in complementary fashion to one another; and the elastic means presses the first and second rings in an axial direction.

4. The drive according to claim 1, wherein:

the first and second rings include recesses in their mutually facing surfaces; and the friction clutch includes elastic elements each of which engages at least one recess of each of the rings, the elastic elements being elastically deformable when the first and second rings rotate with respect to one another.

5. The drive according to claim 4, wherein:

the first and second rings are arranged lying concentrically inside one another; and the elastic elements are comprised of leaf springs.

* * * * *